United States Patent [19]

Osborn

[11] Patent Number: 5,048,252

[45] Date of Patent: Sep. 17, 1991

[54] WINDOW GRID WITH CAM LOCK

[75] Inventor: Richard K. Osborn, Lutz, Fla.

[73] Assignee: Nu-Air Manufacturing Co., Tampa, Fla.

[21] Appl. No.: 596,097

[22] Filed: Oct. 11, 1990

[51] Int. Cl.[5] ..... E06B 3/70

[52] U.S. Cl. ..... 52/456; 52/665; 292/175

[58] Field of Search ..... 52/456, 656, 314, 664, 52/665; 292/175

[56] References Cited

U.S. PATENT DOCUMENTS

| | | | |
|---|---|---|---|
| 3,645,058 | 2/1972 | Jacobson et al. | 52/484 |
| 3,686,814 | 8/1972 | Anderson | 52/456 |
| 4,475,311 | 10/1984 | Gibson | 292/175 |
| 4,723,388 | 2/1988 | Zieg | 52/456 |
| 4,890,435 | 1/1990 | Wilkeming et al. | 52/456 |

*Primary Examiner*—Richard E. Chilcot, Jr.
*Assistant Examiner*—Kien T. Nguyen
*Attorney, Agent, or Firm*—Fleit, Jacobson, Cohn, Price, Holman & Stern

[57] ABSTRACT

A window grid to change the appearance characteristics of a window having a single large window pane to a window having a plurality of smaller window panes or lights. The window grid includes at least one muntin having a thin, rotatable and eccentrically mounted cam lock at each end for engaging the window sash along the surface of the window pane and inwardly of the glazing to securely but detachably lock the muntin to the window sash. The window grid also includes an intersection between muntins which have the same external dimensions with one of the muntins including a passageway therethrough which has a periphery formed by slightly deforming outer portions of the muntin to receive the other muntin therethrough with a friction locking member securing the muntins in their intersected relation. The cam locks are mounted on the inner surface of the muntin and include a pin with a screwdriver receiving kerf in the outer end thereof which extends to and is substantially flush with the outer surface of the muntin.

10 Claims, 1 Drawing Sheet

WINDOW GRID WITH CAM LOCK

BACKGROUND OF THE INVENTION

1. Field of the Invention

The present invention generally relates to a window grid or muntin associated with a window sash having a single, continuous window pane therein in order to change the appearance characteristics of the window to simulate a window having a plurality of smaller window panes or lights. The window grid includes at least one muntin with a thin, rotatable and eccentrically mounted lock at each end for engaging the window sash along the surface of the window pane and inwardly of the glazing to securely but detachably lock the muntin to the window sash. The window grid also includes an intersection between muntins which have the same external dimensions with one of the muntins including a passageway therethrough which has a periphery formed by slightly deforming outer portions of the muntin to receive the other muntin therethrough with a friction locking member securing the muntins in their intersected relation. The muntins are constructed of tubular material of rectangular configuration or any other suitable configuration and provided with inclined end edges to conform with the surface of the window glazing and may be constructed of metal such as aluminum or the like, plastic or any other suitable material with the appearance characteristics of the exterior surface of the muntins being compatible with the window sash and window frame. The cam locks are mounted on the inner surface of the muntin and include a pin with a screwdriver receiving kerf in the outer end thereof which extends to and is substantially flush with the outer surface of the muntin.

2. Description of the Prior Art

Efforts have been previously made to convert a single pane window to a window having the appearance of a multiple pane or multiple light window by attaching muntins or mullions to the surface of the window pane or to the sash. This arrangement provides a window structure which is less expensive and easier to maintain than a conventional multi-light window. However, the previous arrangements of this type, some of which are no more than plastic strips, are in some instances not securely retained in place and in other instances cannot be easily assembled and disassembled with respect to the existing window. The prior art in this field of endeavor does not disclose the connection between the window grid formed by the muntins and the window sash. Further, the prior art does not disclose the specific intersection between the muntins forming the window grid.

SUMMARY OF THE INVENTION

An object of the present invention is to provide a window grid to convert a single pane or light window into a window having the appearance characteristics of a multiple pane or light window and includes a novel cam lock securing the muntins forming the window grid to a window sash.

Another object of the invention is to provide a window grid with cam locks as set forth in the preceding object in which the muntins have a novel intersection which provides a mechanically secure intersection as well as an intersection that enables the intersecting muntins to be positioned substantially in the same plane.

A further object of the invention is to provide a cam lock for a window grid formed by intersecting muntins in which the cam lock is in the form of a thin plate member having a semicircular thin edge at one end thereof and the other end being rotatably mounted on the inner surface of the muntin for rotation about an axis eccentric to the plate with the mounting structure for the cam lock including a pin rigid with the plate which extends through and is substantially flush with the outer surface of the muntin and is provided with a kerf to receive a screwdriver or the like in order to rotate the thin rounded edge of the plate into and out of engagement with the window sash along the surface of the glass and inwardly of the glazing.

Still another object of the invention is to provide a window grid with a cam lock and muntin intersection that is relatively simple in construction, easy to assembly and disassemble in relation to existing windows to enhance the appearance of the windows and to enable easy removal for cleaning or other maintenance of the windows.

These together with other objects and advantages which will become subsequently apparent reside in the details of construction and operation as more fully hereinafter described and claimed, reference being had to the accompanying drawings forming a part hereof, wherein like numerals refer to like parts through-out.

DESCRIPTION OF THE PREFERRED EMBODIMENT

Figure 1:
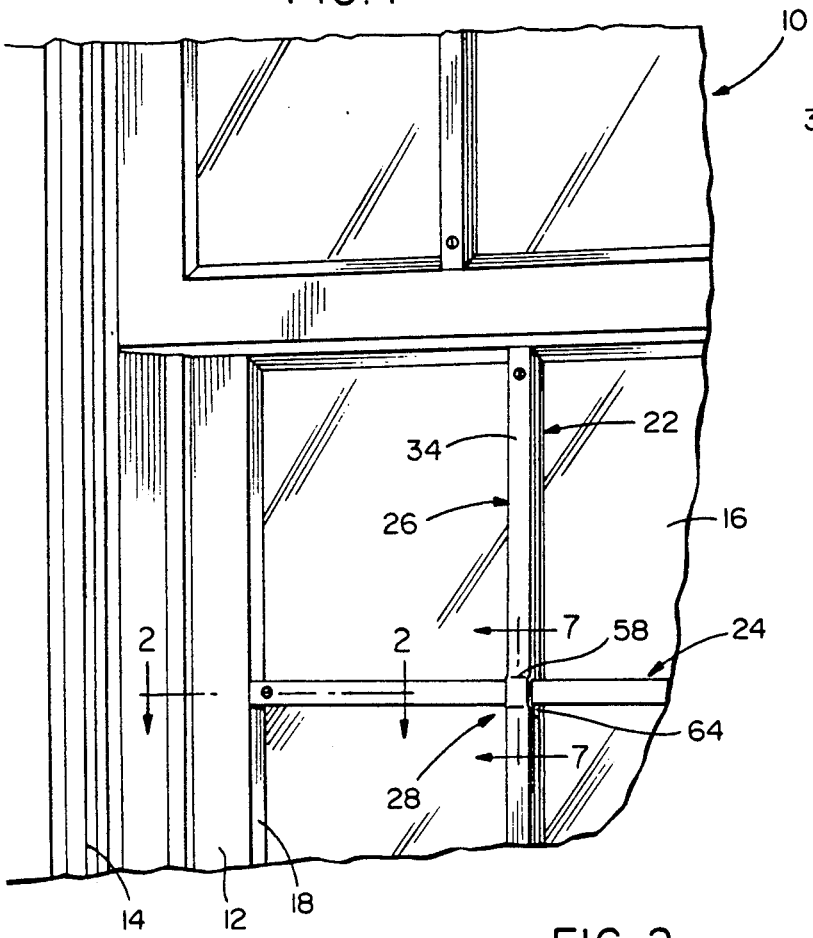
FIG. 1 is a perspective view of a window sash with the window grid of the present invention incorporated therein.
Figure 2:
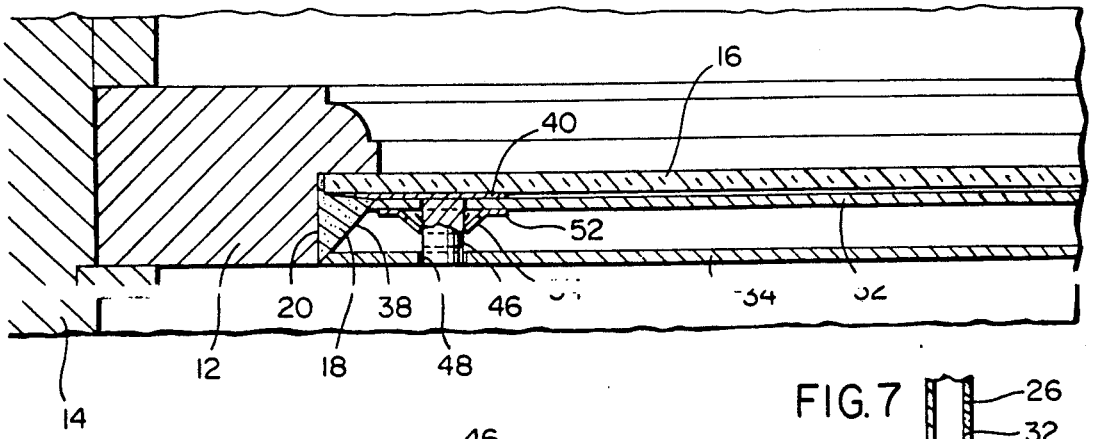
FIG. 2 is a detailed sectional view, on an enlarged scale, taken substantially upon a plane passing along section line 2—2 on FIG. 1 illustrating the specific structure of the cam lock and its association with the muntin and components of the window.
Figure 5:
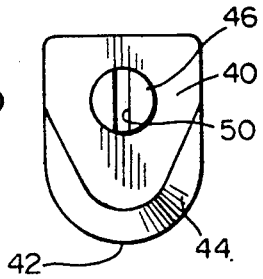
FIG. 5 is a top plan view of the cam lock separate from the muntin.
Figure 6:
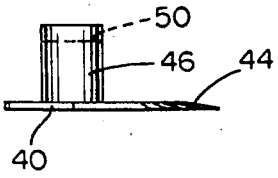
FIG. 6 is a side elevational view of the cam lock.

Referring now specifically to the drawings, FIG. 1 illustrates a window structure generally designated by reference numeral 10 including a window sash 12 received in a window frame 14 in a conventional manner. The window sash 12 is illustrated in association with another window sash as in a conventional double hung window. The window sash 12 includes a continuous single pane or light of glass 16 or other transparent material with the periphery of the glass pane 16 being retained in the window sash in a conventional manner by the use of glazing 18 which bridges and fills the recess 20 in the inner edge of the window sash 12 with the periphery of the pane 16 also being received in the recess 20 as illustrated in FIG. 2. This structure of the window sash and window frame is conventional as is the glazing. A window grid generally designated by reference numeral 22 is positioned against the exterior surface of the window pane 16 in order to convert the window 10 from a window having a single large window pane in each window sash to a window which includes a plurality of muntins or mullions in each window sash.

The window grid includes muntins 24 and 26 which are disposed in perpendicular intersecting relation at an intersection generally designated by the numeral 28 with the ends of the muntins being secured to the window sash 12 by a cam lock generally designated by reference numeral 30.

Each of the muntins is of hollow rectangular cross-sectional configuration including an inner wall 32 and an outer wall 34 interconnected by side walls 36 which are slightly inwardly spaced from the outer edges of the walls 32 and 34. Also, the end edge of each muntin is beveled or inclined at 38 with the inner wall 32 being shorter than the outer wall 34 to conform generally with the inclined surface of the glazing 18 as illustrated in FIG. 2.

Figure 3:
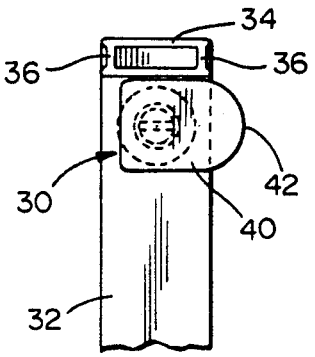
FIG. 3 is a fragmental elevational view of the cam lock illustrating it in unlocked position.
Figure 4:
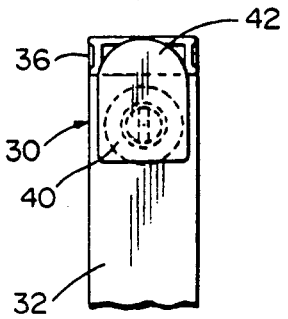
FIG. 4 is a view similar to FIG. 3 but with the cam lock in extended or locked position.

Each cam lock 30 includes a thin plate 40 of generally rectangular configuration with one end of the plate being rounded generally into semicircular configuration as indicated by numeral 42 and this edge of the plate is also beveled to form a sharpened edge 44 with the bevel extending from an inner surface of the plate to the outer surface thereof. Eccentrically mounted on the plate 40 is a pin or stud 46 which extends through an aperture 48 which extends through the muntin and terminates flush with the outer surface of the outer wall 34 as illustrated in FIG. 2. The outer end of the pin 46 is provided with a diametrically extending kerf 50 for receiving a screwdriver or similar tool which enables the pin 46 and locking plate 40 to be rotated about the axis of the pin 46 to move the rounded end 42 of the plate from a position extending laterally from the muntin as illustrated in FIG. 3 which is the unlocked position of the cam lock to a position extending beyond the end of the inner wall 32 as illustrated in FIG. 4 which is the locked position of the cam lock. The pin 46 is retained in assembled relation to the muntin by the use of an apertured retaining washer 52 having spring tangs 54 thereon engaging the pin and retaining it in rotatable relation to the inner wall 32. This fastening arrangement may be in the form of a conventional Tinnerman fastener.

The window grid 22 is assembled onto the window by merely positioning it against the glass pane 16 when the cam locks 30 are in their unlocked position as illustrated in FIG. 3. The cam locks are then actuated to extend the thin beveled or sharp edge 44 into underlying engagement with the glazing and into engagement with the window sash by the use of a screwdriver engaged with the kerf or slot 50 which is in parallel relation to the long axis of the cam lock which provides an indication that the cam lock is in locked position when the kerf or slot 50 is parallel to the longitudinal axis of the muntin.

Figure 7:
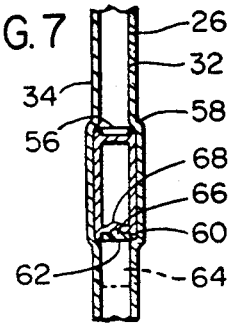
FIG. 7 is a sectional view taken along section line 7—7 on FIG. 1 illustrating the specific structure of the intersection between the muntins.

The intersection 28 between muntins 24 and 26 of the window grid 22 is illustrated in detail in FIG. 7 in which the muntin 26 includes a passageway 56 extending therethrough with the passage being formed by removal of a portion of the side walls 36 and slight outward deformation of the walls 32 and 34 as indicated at reference numeral 58. This provides sufficient cross-sectional area for the passageway 56 to slidably receive the intersecting muntin 24 in perpendicular relation thereto. The intersection of the muntins is frictionally locked in tight relationship by a U-shaped plastic clip 60 which extends through the passageway with the bight portion 62 engaging over the ends of the side walls 36 forming one side of the passageway 56 and end flanges 64 which extend along the outer surface of the side walls 36 in generally concealed relation between the projecting edges of the inner and outer walls 32 and 34. The central portion of the clip 60 is provided with a short protuberance 66 that is engaged with a slight indentation 68 in the side wall 36 of the muntin 24 thus frictionally retaining the muntins 24 and 26 in a secure intersecting relationship but still enabling them to be assembled and disassembled thereby enabling the muntins to be stored, transported and handled while separated and easily assembled at the job site.

The window grid may be constructed of any suitable material including die cast metal such as aluminum or the like, plastic or other similar materials with the exterior surfaces thereof being coated by painting or the like. The surfaces may be painted white, bronze, or any other color compatible with the appearance characteristics of the window sash and frame. The thin plate 40 and the sharpened rounded edge thereof provides secure mounting of the muntins and will form a cavity which receives the locking edge of the plate and prevents lateral movement in relation to the window and glazing without exerting compressive forces on the muntin which would tend to cause the muntin to flex outwardly. Also, the cross-sectional configuration of the hollow muntins provides a very rigid structure in its longitudinal direction. The actual cross-sectional configuration of the exterior surface of the muntin may be varied depending upon the ornamental characteristics desired. This window grid provides an inexpensive and attractive grid for converting a single pane window to a multiple pane window with the grid being easily assembled and disassembled in relation to the window.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A window grid for converting a single pane window to a window having the appearance characteristics of a multi-pane window, said grid comprising at least one muntin extending between opposed portions of a window sash, means on each end of the muntin for securing the muntin to the window sash, said means on each end of the muntin including a cam lock, said cam lock including a rotatable plate positioned on the inner surface of the muntin and having a rounded beveled edge and an outwardly extending lateral pin connected with the plate and rotatably journaled in the muntin, said pin being eccentrically positioned on the plate to move the beveled edge into and out of engagement with the window sash when the plate is rotated between a locked position in alignment with the muntin to an unlocked position in angular relation to the muntin.

2. The grid as defined in claim 1 wherein said pin includes means on the outer end thereof for engagement with a tool to enable rotational movement of the plate.

3. The grid as defined in claim 2 wherein said plate is generally rectangular with the pin being adjacent one end thereof and the other end being generally semicircular with the surface of the semicircular end being beveled with the bevel extending from an inner end adjacent the surface of the muntin to an outer edge spaced therefrom for insertion between the window pane and window glazing on a window sash.

4. The grid as defined in claim 1 together with at least one additional muntin, said muntins being in intersecting perpendicular relation with each of the muntins including a cam lock at the outer end thereof.

5. The grid as defined in claim 4 wherein said pin includes means on the outer end thereof for engagement with a tool to enable rotational movement of the plate.

6. The grid as defined in claim 5 wherein the intersecting muntins are disposed in substantially the same plane with one of said muntins including a passageway therethrough to receive the other muntin.

7. The grid as defined in claim 6 wherein the passageway through said one muntin is slightly larger than the cross-sectional area of the other muntin to enable sliding assembly of the muntins.

8. The grid as defined in claim 7 wherein the intersection between the muntins includes a generally U-shaped clip having a bight portion received in the passageway and flanges engaging opposite sides of the muntin having the passageway therethrough with the clip being constructed of material to frictionally engage the other muntin to provide a secure intersection between the muntins with the clip providing a frictional contact with the muntin extending through the passageway to retain the muntins in secure, assembled and intersecting relation.

9. The grid as defined in claim 8 wherein each end of each muntin is inclined to conform with and engage the glazing on the window sash.

10. A window grid comprising a pair of intersecting muntins disposed in the same plane, one of said muntins including a passageway receiving the other muntin therethrough, said passageway being formed by spaced inner and outer continuous walls overlying and concealing portions of inner and outer continuous walls on said other muntin, the intersection between the muntins including a generally U-shaped clip having a bight portion received in the passageway and flanges engaging opposite sides of the muntin having the passageway therethrough, said clip being constructed of material to frictionally engage the other muntin to provide a secure intersection between the muntins, said bight portion of the clip being in frictional contact with a side wall on the muntin extending through the passageway to retain the muntins in secure, assembled and intersecting relation.

* * * * *